US007792476B2

(12) United States Patent
Seol et al.

(10) Patent No.: US 7,792,476 B2
(45) Date of Patent: Sep. 7, 2010

(54) FUSING APPARATUS AND ELECTROPHOTOGRAPHIC IMAGE-FORMING APPARATUS HAVING THE SAME

(75) Inventors: Dong-jin Seol, Suwon-si (KR); Hwan-hee Kim, Suwon-si (KR); Hwan-guem Kim, Seoul (KR); Tae-gyu Kim, Hwaseong-si (KR); Su-ho Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 76 days.

(21) Appl. No.: 12/125,312

(22) Filed: May 22, 2008

(65) Prior Publication Data

US 2008/0317527 A1 Dec. 25, 2008

(30) Foreign Application Priority Data

Jun. 19, 2007 (KR) ..... 10-2007-0060041

(51) Int. Cl.
*G03G 15/20* (2006.01)

(52) U.S. Cl. ..... 399/329; 219/216

(58) Field of Classification Search ..... 399/328, 399/329, 330; 219/216; 347/156; 118/60; 432/60

See application file for complete search history.

(56) References Cited

U.S. PATENT DOCUMENTS 6,078,027 A * 6/2000 Natsuhara et al. ..... 219/216
6,442,365 B1 8/2002 Schlueter, Jr. et al.
6,836,637 B2 * 12/2004 Kelsay ..... 399/330
7,593,679 B2 * 9/2009 Masubuchi ..... 399/329
2003/0002895 A1 1/2003 Kato et al.
2004/0062578 A1 * 4/2004 Kim et al. ..... 399/328
2005/0100373 A1 5/2005 Kishino et al.
2005/0180788 A1 * 8/2005 Watanabe et al. ..... 399/328
2006/0115305 A1 * 6/2006 Lofthus et al. ..... 399/328
2006/0177251 A1 8/2006 Uehara et al.
2008/0232871 A1 * 9/2008 Jung et al. ..... 399/329
2009/0016789 A1 * 1/2009 Kim et al. ..... 399/329
2009/0092423 A1 * 4/2009 Shin et al. ..... 399/329
2009/0110451 A1 * 4/2009 Jung et al. ..... 399/329

FOREIGN PATENT DOCUMENTS

EP 1927902 6/2008
EP 1973011 9/2008

OTHER PUBLICATIONS

European Search Report issued Jul. 9, 2009 in EP Application No. 08158313.0.

* cited by examiner

*Primary Examiner*—Sophia S Chen
(74) *Attorney, Agent, or Firm*—Stanzione & Kim, LLP

(57) ABSTRACT

A fusing apparatus includes a heating unit to generate heat to fuse an image onto a printing medium, a pressurizing roller that faces and contacts the heating unit having an endless fusing film that is rotated while facing and contacting the pressurizing roller and presses the printing medium toward the heating unit, a nip forming member including a main body formed inside the fusing film to surround a heat source and contacts a portion of the fusing film to the pressurizing roller to form a nip. The fusing apparatus further includes a supporting member to support the nip forming member.

18 Claims, 17 Drawing Sheets

FIG. 1 (CONVENTIONAL)
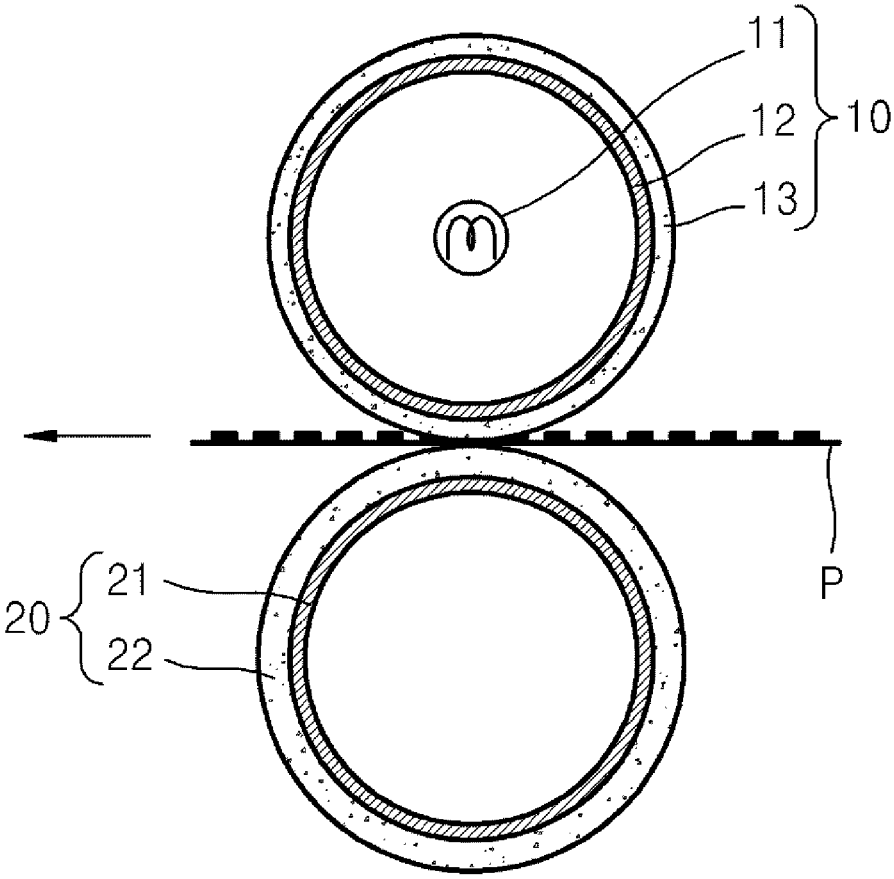

FUSING APPARATUS AND ELECTROPHOTOGRAPHIC IMAGE-FORMING APPARATUS HAVING THE SAME

CROSS-REFERENCE TO RELATED APPLICATIONS

This application claims priority under 35 U.S.C. §119(a) from Korean Patent Application No. 10-2007-0060041, filed on Jun. 19, 2007, in the Korean Intellectual Property Office, the disclosure of which is incorporated herein in its entirety by reference.

BACKGROUND OF THE INVENTION

1. Field of the Invention

The present general inventive concept relates to an electrophotographic image forming apparatus, and more particularly, to an electrophotographic image forming apparatus including a fusing apparatus fusing an image on a printing medium.

2. Description of the Related Art

In general, an electrophotographic image forming apparatus forms an image by forming an electrostatic latent image using an exposing unit such as a laser scanning unit that receives a digital image signal, developing the latent image into a toner image using a developing agent such as toner, transferring the toner image to a printing medium, and then fusing the toner image on the printing medium by applying heat and pressure. Accordingly, the electrophotographic image forming apparatus includes a fusing apparatus that applies heat and pressure to the toner image to fuse the toner image on the printing medium.

The fusing apparatus includes a heating roller generating heat and a pressurizing roller that is disposed to face a fusing roller to press the printing medium to which the toner image is transferred toward the heating roller. Various types of fusing rollers operating according to the way heat is generated have been developed.

FIG. 1 is a longitudinal cross-sectional view illustrating a conventional fusing apparatus.

Referring to FIG. 1, the fusing apparatus includes a heating roller 10 and a pressurizing roller 20.

The heating roller 10 includes a tubular metal core pipe 12, an elastic rubber layer or a release layer 13 formed on an outer circumference of the metal core pipe 12, and a halogen lamp 11 which is placed inside the metal core pipe 12 and generates heat. The elastic rubber layer is elastically deformed when contacting the pressurizing roller 20, thereby a nip being easily formed therebetween. The release layer 13 is coated with Teflon™. The heat generated from the halogen lamp 11 is transferred to the metal core pipe 12 by radiation, and is further transferred to the outer circumference of the metal core pipe 12 by conduction.

The pressurizing roller 20 faces and contacts the heating roller 10, and is pressed toward the heating roller 10 by an elastic unit (not illustrated), thereby pressing a printing medium that passes between the pressurizing roller 20 and the heating roller 10. The pressurizing roller 20 includes a tubular metal core pipe 21 and a release layer 22 formed on the outer circumference of the metal core pipe 21.

The fusing apparatus having the above-described structure has a large thermal capacity, and thus the fusing apparatus takes a considerably long warm-up time to reach the fusing temperature when power is supplied for printing. Thus, the first print out time (FPOT) is long.

SUMMARY OF THE INVENTION

The present general inventive concept provides a fusing apparatus including a rotatable belt having a small thermal capacity so that a warm-up time can be shortened by directly radiating heat from a heat source to a nip, thereby reducing a first print out time (FPOT), and an electrophotographic image forming apparatus including the fusing apparatus.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a fusing apparatus including a heating unit to generate heat to fuse an image onto a printing medium, a pressurizing roller that faces and contacts the heating unit having an endless fusing film that is rotated while facing and contacting the pressurizing roller and presses the printing medium toward the heating unit, a nip forming member including a main body formed inside the fusing film to surround a heat source and contacts a portion of the fusing film to the pressurizing roller to form a nip, a plurality of opening forming portions connected to the main body and form an opening portion such that heat generated from the heat source directly arrives at the fusing film via the opening portion, and a plurality of adhering portions connected to the opening forming portions, are separated from each other, having the opening portion therebetween, and contact the fusing film, and a supporting member to support the nip forming member.

The foregoing and/or other aspects and utilities of the general inventive concept may also be achieved by providing an electrophotographic image forming apparatus including a plurality of developing cartridges in which toner of various colors is stored to develop an electrostatic latent image into a toner image, a transferring belt to transport a printing medium while contacting the printing medium to the developing cartridges, a fusing apparatus to fuse the toner image on the printing medium, the fusing apparatus includes a heating unit to generate heat to fuse an image onto a printing medium, a pressurizing roller that faces and contacts the heating unit having an endless fusing film that is rotated while facing and contacting the pressurizing roller and presses the printing medium toward the heating unit, a nip forming member including a main body formed inside the fusing film to surround a heat source and contacts a portion of the fusing film to the pressurizing roller to form a nip, a plurality of opening forming portions connected to the main body and form an opening portion therebetween such that heat generated from the heat source directly arrives at the fusing film via the opening portion, and a plurality of adhering portions connected to the opening forming portions, are separated from each other, having the opening portion therebetween, and contact the fusing film, and a supporting member to support the nip forming member.

The foregoing and/or other aspects and utilities of the general inventive concept may also be achieved by providing a fusing apparatus usable with an image forming apparatus, the fusing apparatus including a pressurizing roller, a heating unit having a fusing film to contact the pressurizing roller, and a nip forming member including a main body formed inside the fusing film to surround a heat source and a plurality of opening forming portions connected to the main body to form an opening portion, wherein heat generated from the heat source is directly applied to the fusing film through one or more of the opening portion.

The main body may contact a portion of the fusing film to the pressurizing roller to form a nip.

The heat source may be disposed along a center of the pressurizing roller and in a middle of one or more of the opening forming portions.

The foregoing and/or other aspects and utilities of the general inventive concept may also be achieved by providing a fusing apparatus usable with an image forming apparatus, the fusing apparatus including a pressurizing roller, a fusing film to contact the pressurizing roller, and a nip forming member including a plurality of adhering portions disposed on each side of an opening portion, wherein a tension in the fusing film created by a pressing force of the plurality of adhering portions and an elastic force in the pressurizing roller act together to limit a reduction of a pressure force in the opening portion.

BRIEF DESCRIPTION OF THE DRAWINGS

The above and other features and utilities of the present general inventive concept will become more apparent by describing in detail exemplary embodiments thereof with reference to the attached drawings in which:

FIG. 1 is a longitudinal cross-sectional view illustrating a conventional fusing apparatus;

DETAILED DESCRIPTION OF THE PREFERRED EMBODIMENTS

Figure 2:
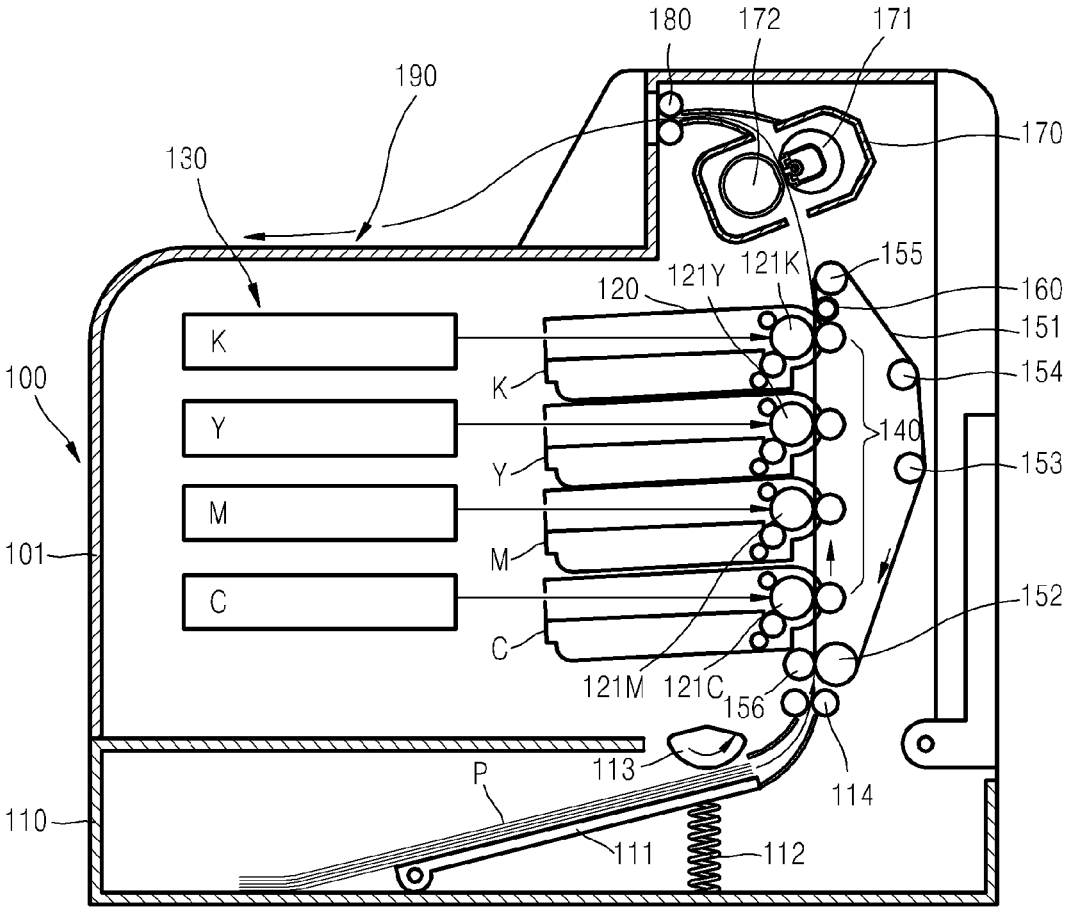
FIG. 2 is a lateral cross-sectional view illustrating an electrophotographic image forming apparatus including a fusing apparatus according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
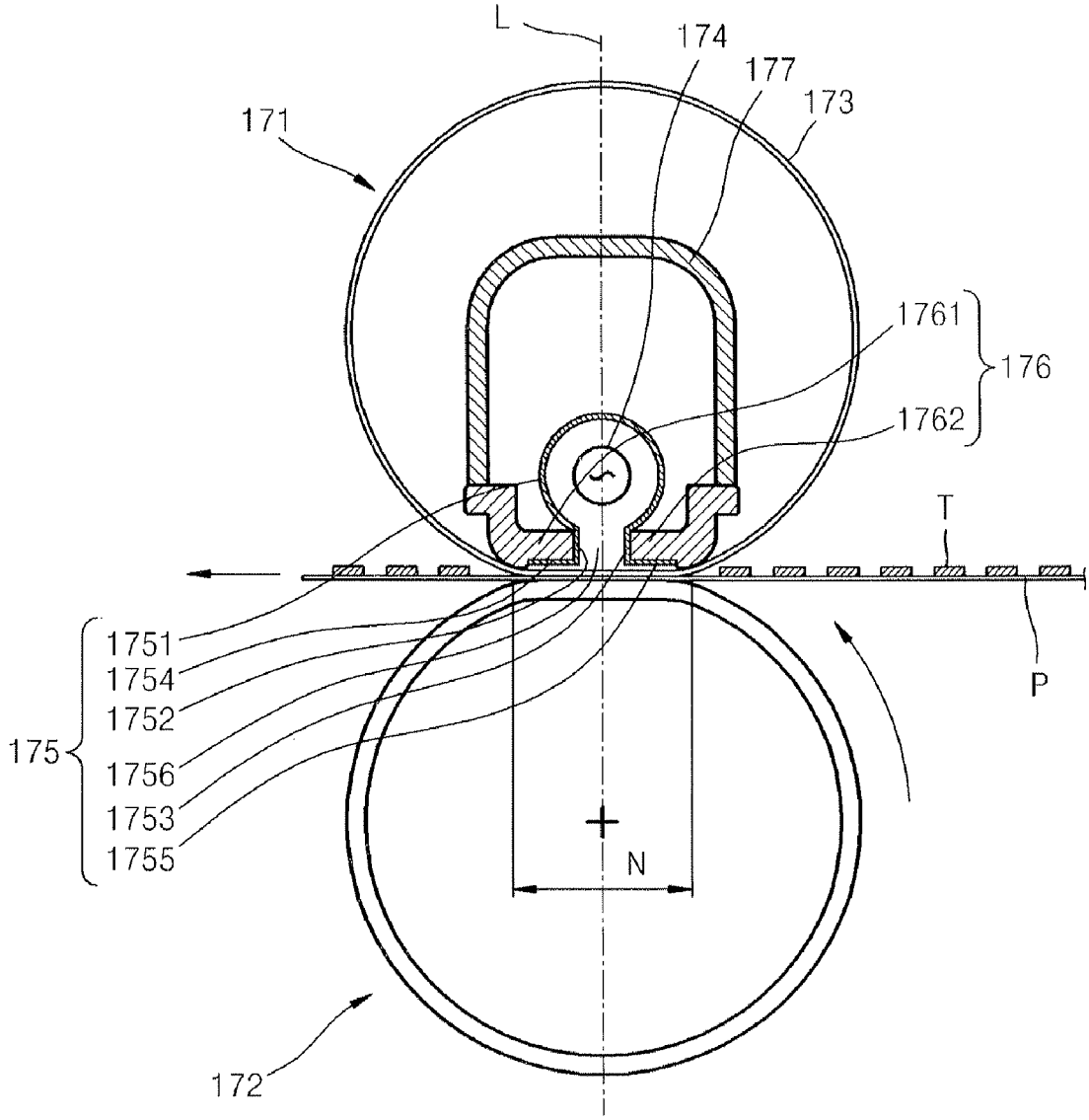
FIG. 3 is a longitudinal cross-sectional view illustrating the fusing apparatus illustrated in FIG. 2.
Figure 4:
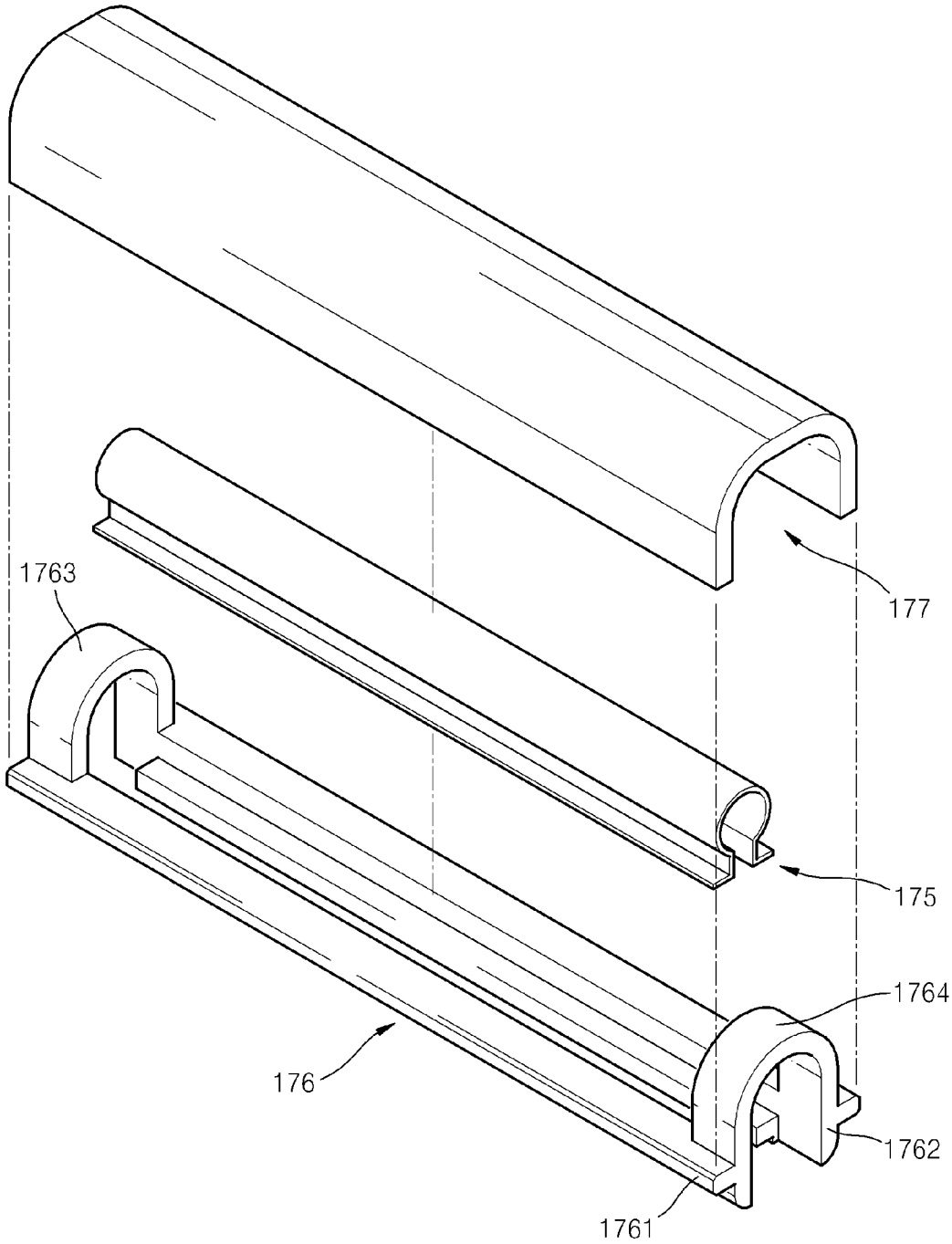
FIG. 4 is a perspective view separately illustrating a nip forming member, a supporting member, and a pressing member illustrated in FIG. 3.
Figure 5A:
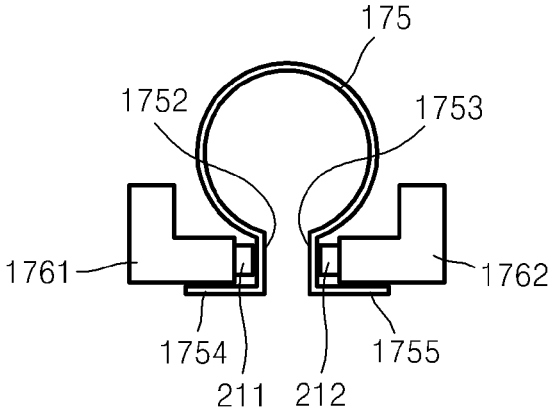
FIGS. 5A and 5B illustrate a supporting member according to an embodiment of the present general inventive concept.
Figure 5B:
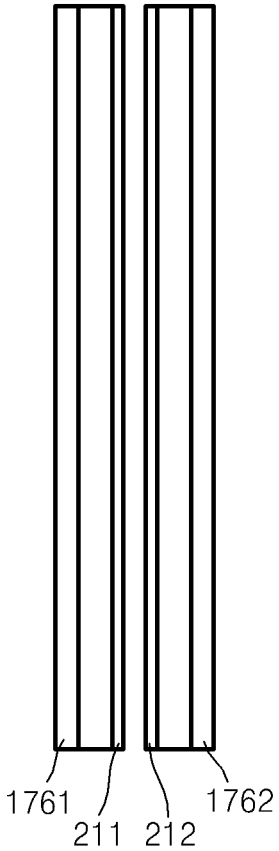
Figure 6:
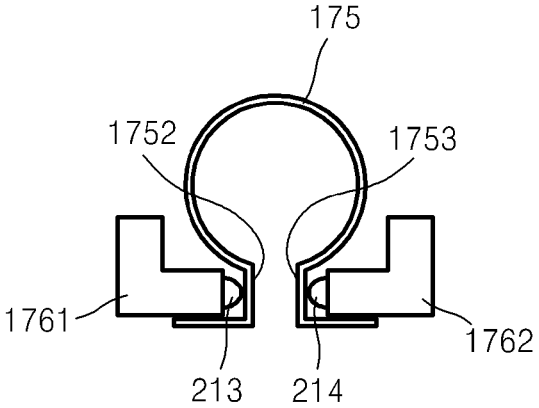
FIG. 6 illustrates a supporting member according to another embodiment of the present general inventive concept.
Figure 7A:
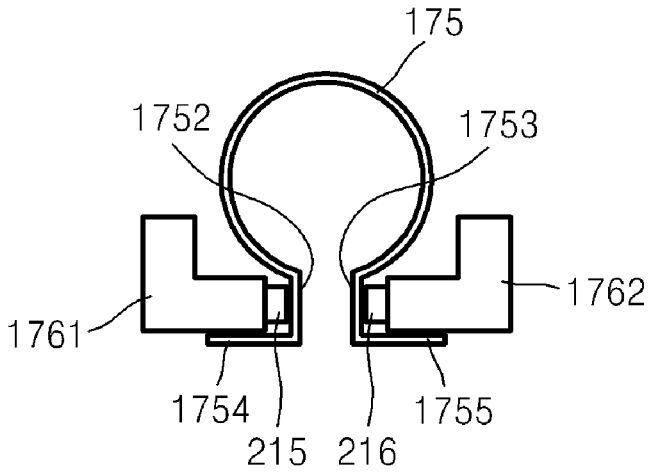
FIGS. 7A and 7B illustrate a supporting member according to another embodiment of the present general inventive concept.
Figure 7B:
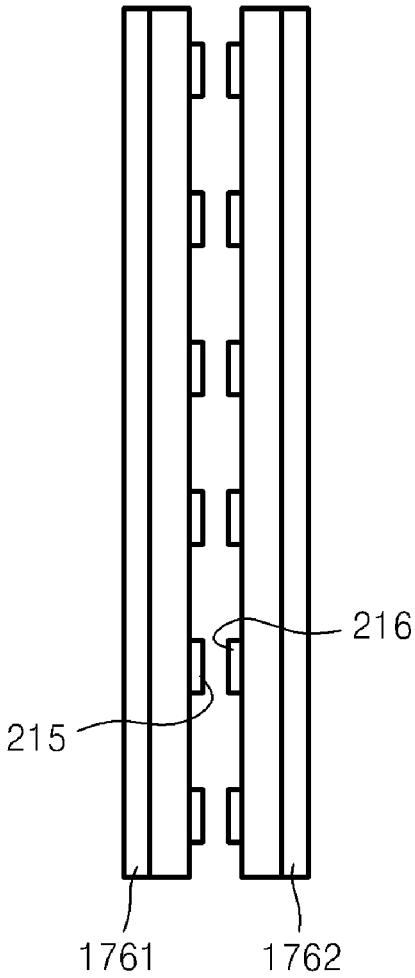
Figure 8A:
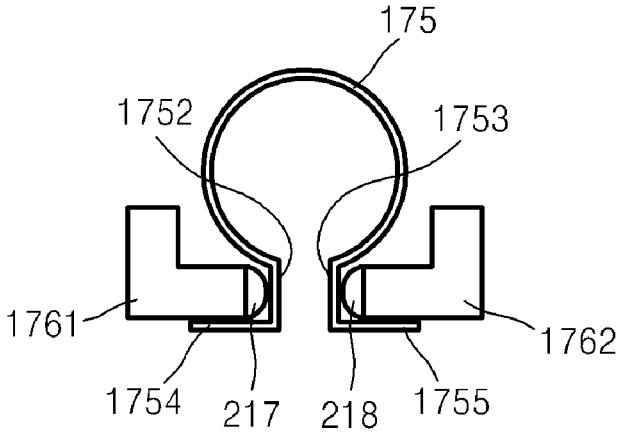
FIGS. 8A and 8B illustrate a supporting member according to another embodiment of the present general inventive concept.
Figure 8B:
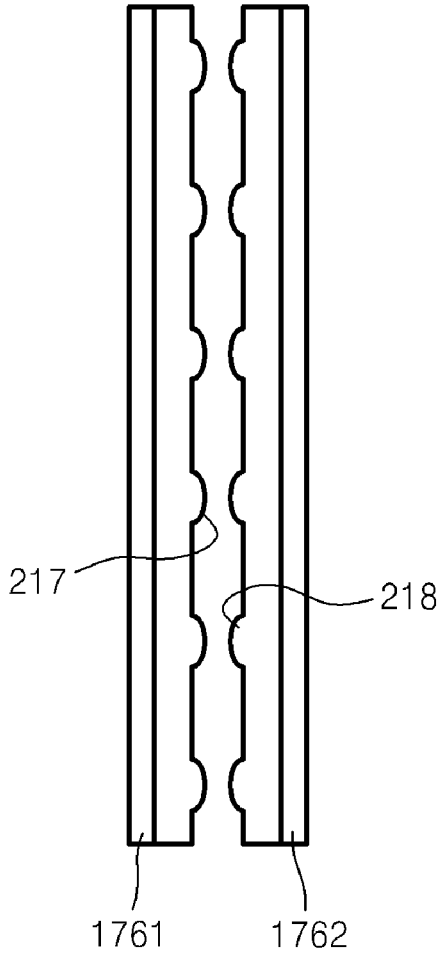
Figure 9A:
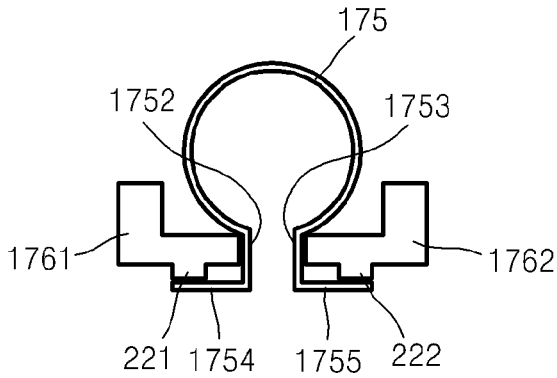
FIGS. 9A and 9B illustrate a supporting member according to another embodiment of the present general inventive concept.
Figure 9B:
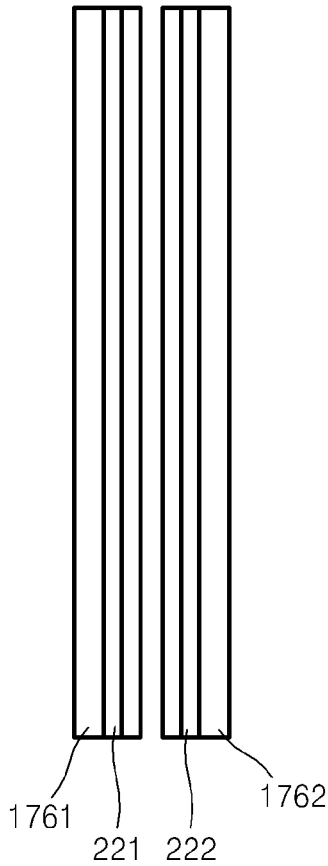
Figure 10:
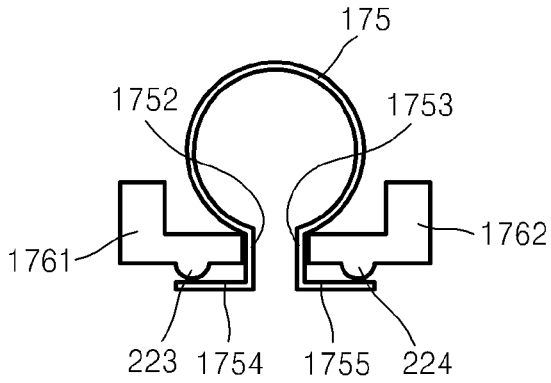
FIG. 10 illustrates a supporting member according to another embodiment of the present general inventive concept.
Figure 11A:
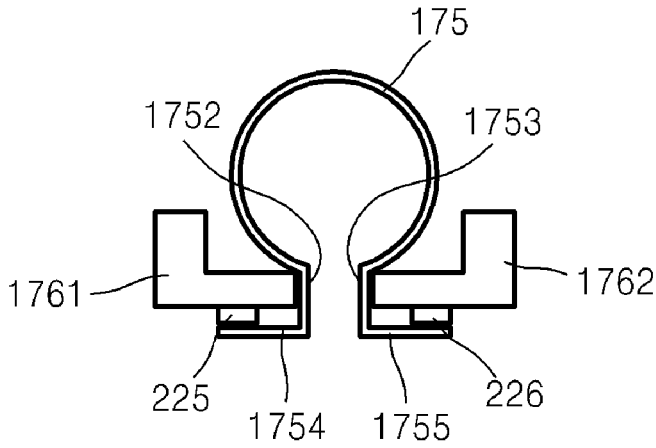
FIGS. 11A and 11B illustrate a supporting member according to another embodiment of the present general inventive concept.
Figure 11B:
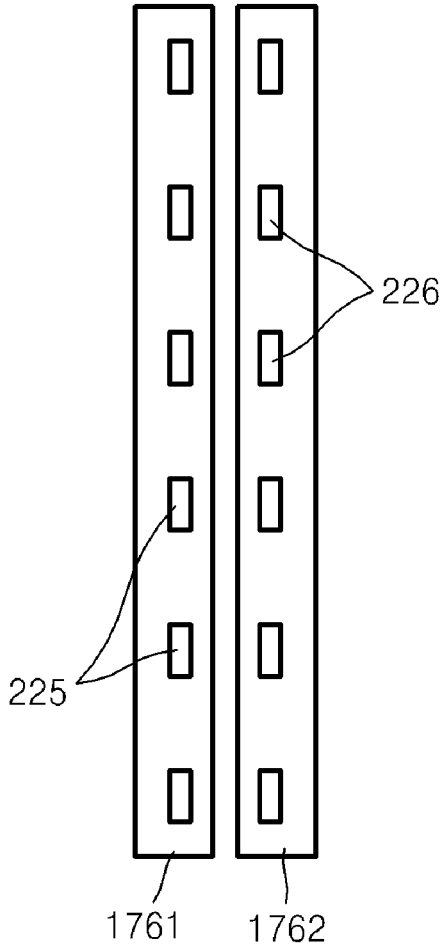
Figure 12A:
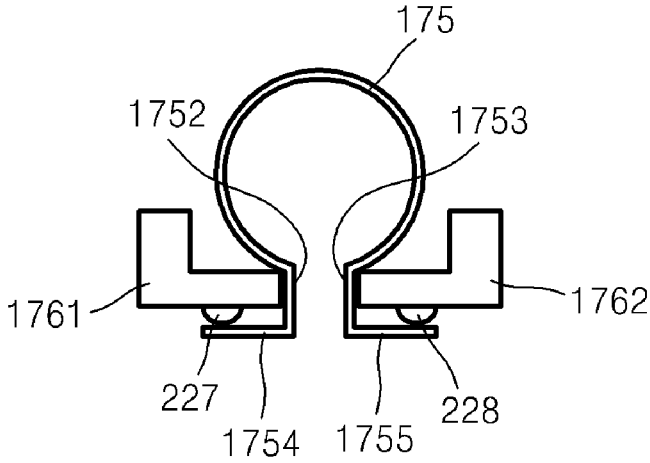
FIGS. 12A and 12B illustrate a supporting member according to another embodiment of the present general inventive concept.
Figure 12B:
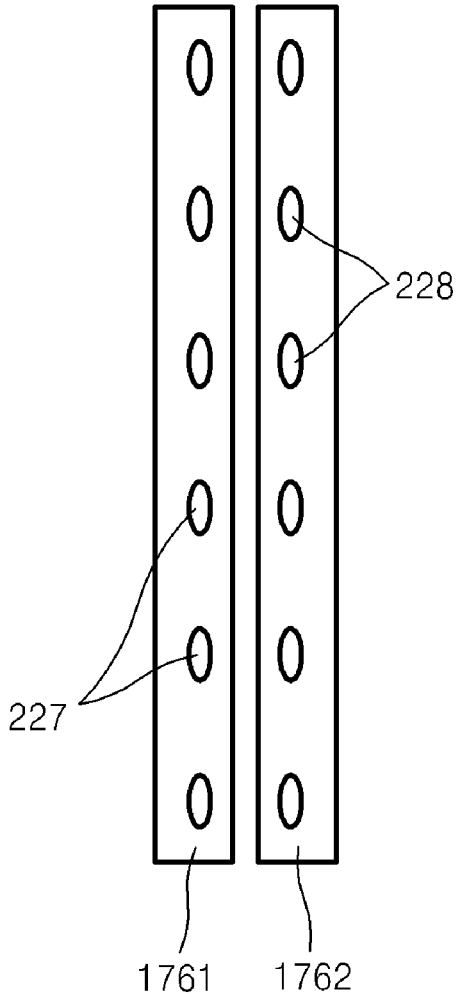
Figure 13B:
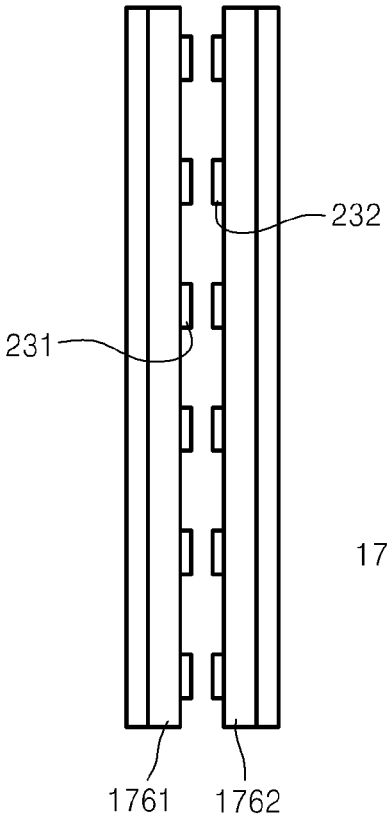
FIGS. 13A through 13C illustrate a supporting member according to another embodiment of the present general inventive concept.
Figure 13A:
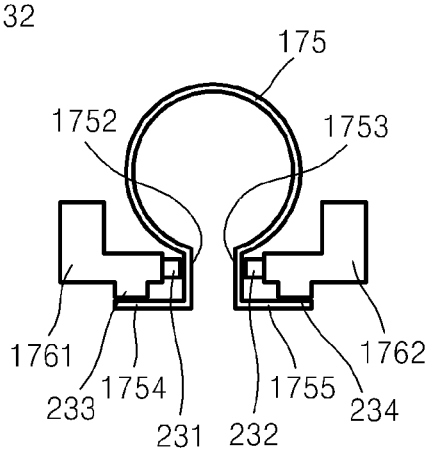
Figure 14:
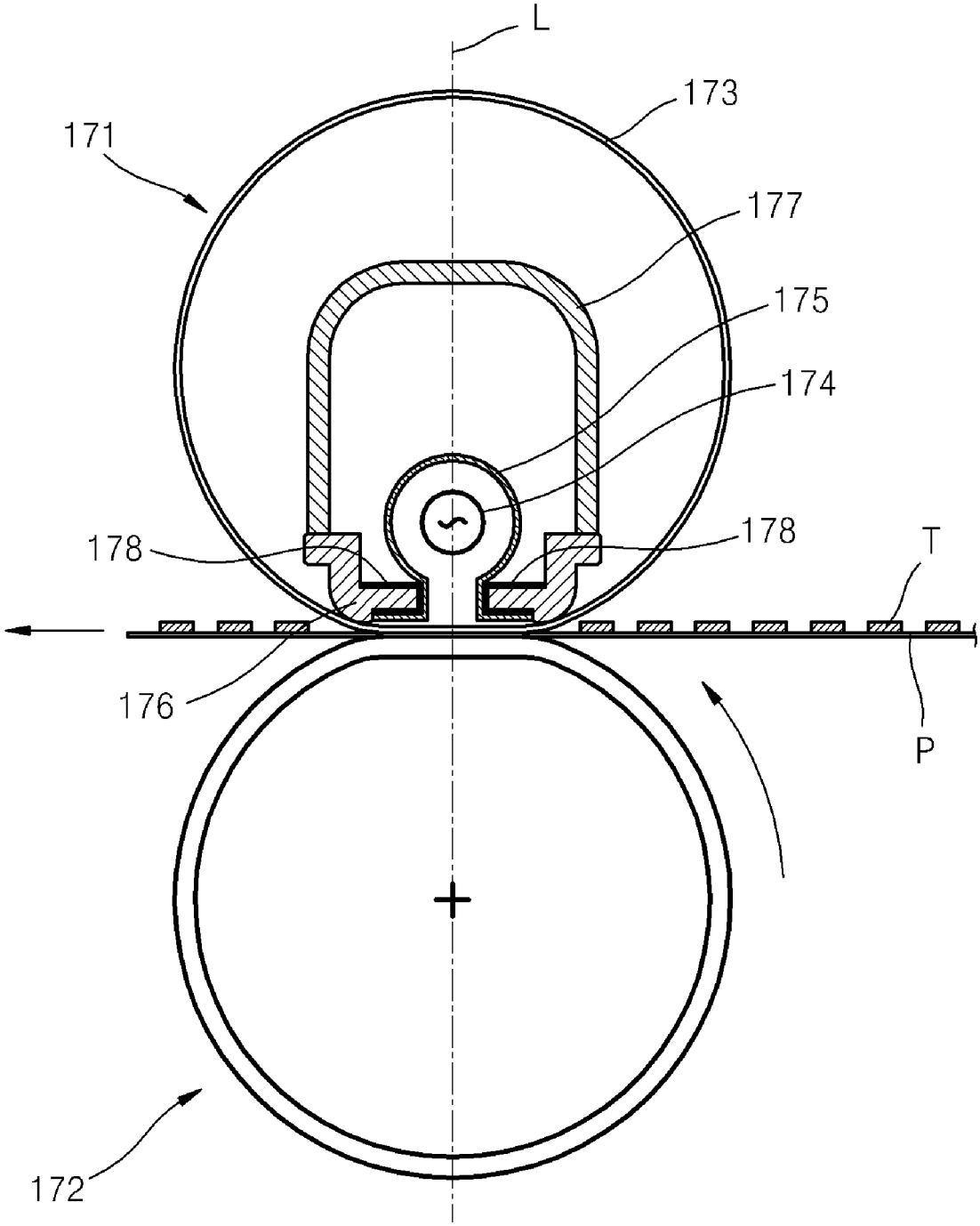
FIG. 14 illustrates a supporting member according to another embodiment of the present general inventive concept.
Figure 15:
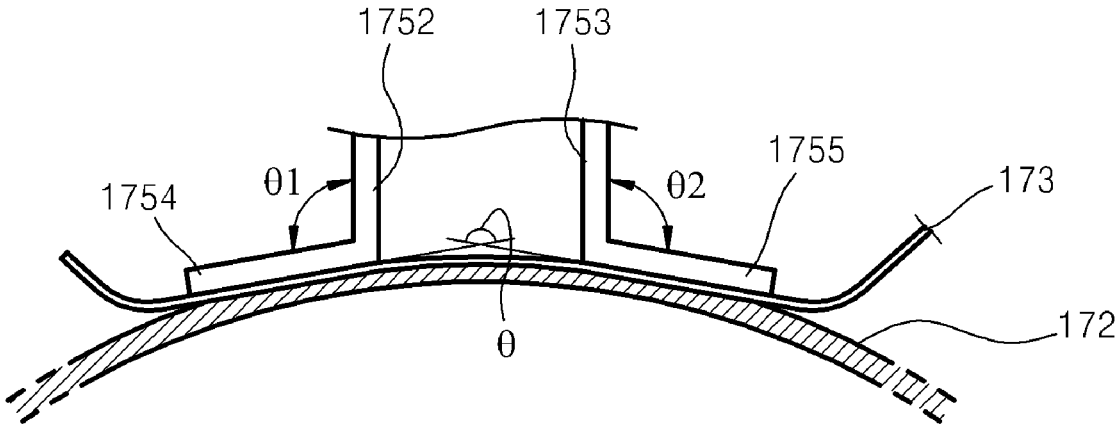
FIG. 15 illustrates a nip forming member according to another embodiment of the present general inventive concept.
Figure 16A:
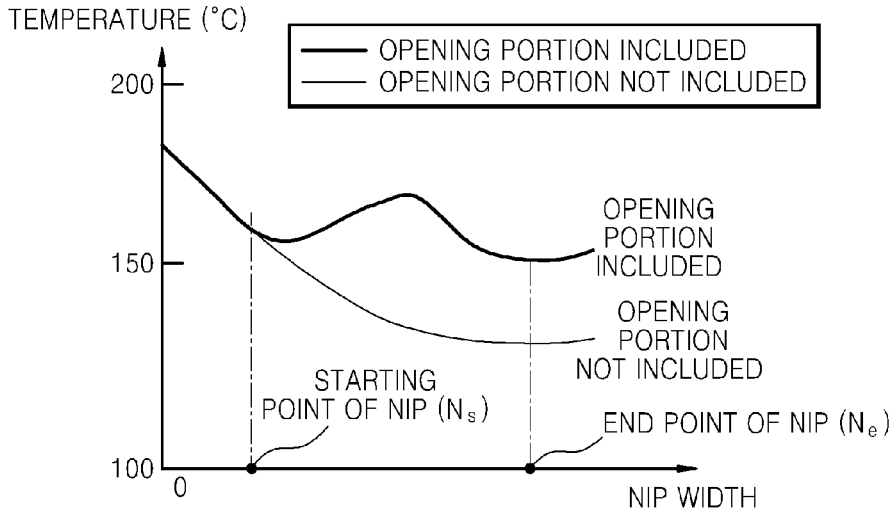
FIG. 16A is a graph illustrating a temperature change in a nip of the fusing apparatus according to an embodiment of the present general inventive concept.
Figure 16B:
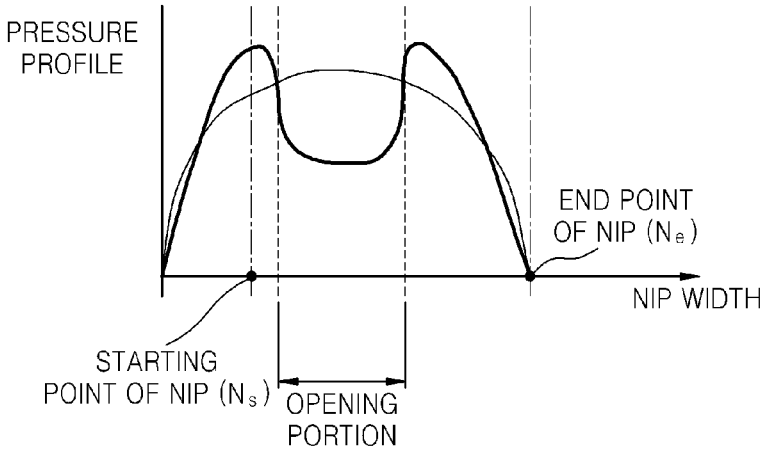
FIG. 16B is a graph illustrating a pressure change in a nip of the fusing apparatus according to an embodiment of the present general inventive concept.
Figure 17:
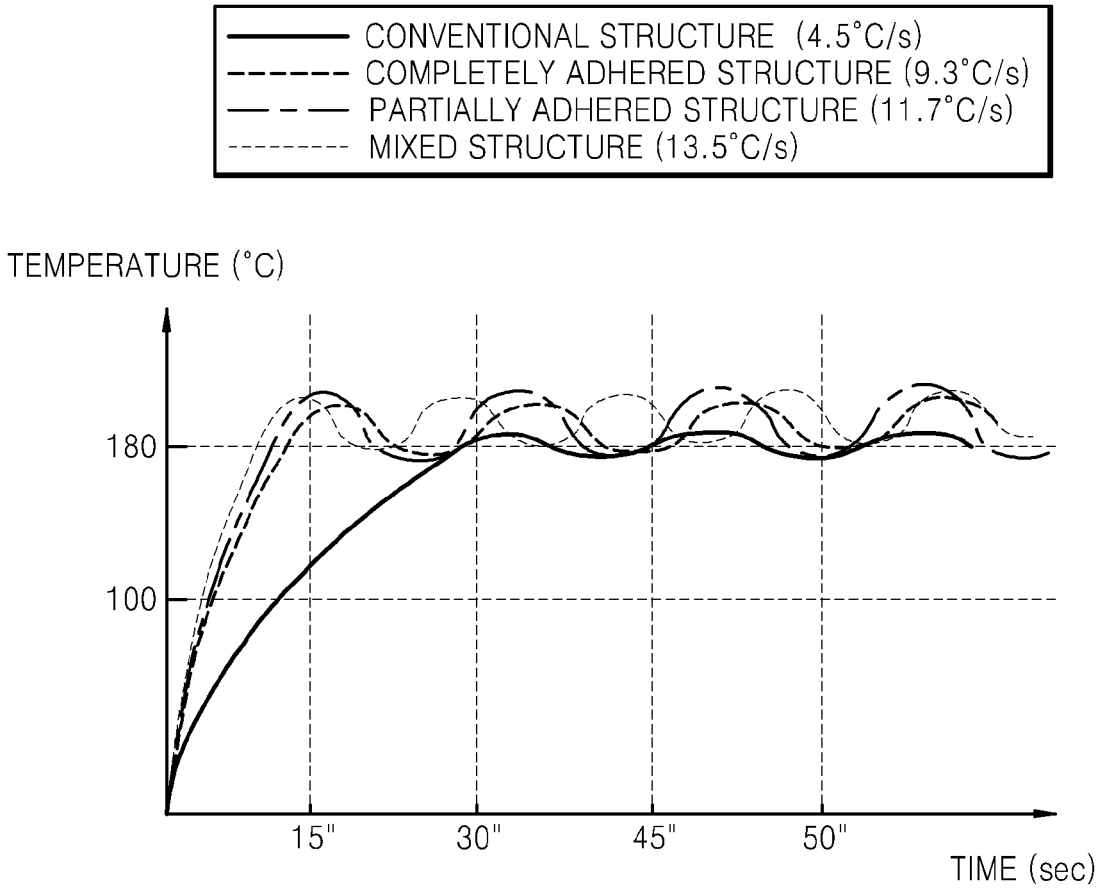
FIG. 17 is a graph illustrating a temperature increase rate of the supporting member according to an embodiment of the present general inventive concept.
Figure 18:
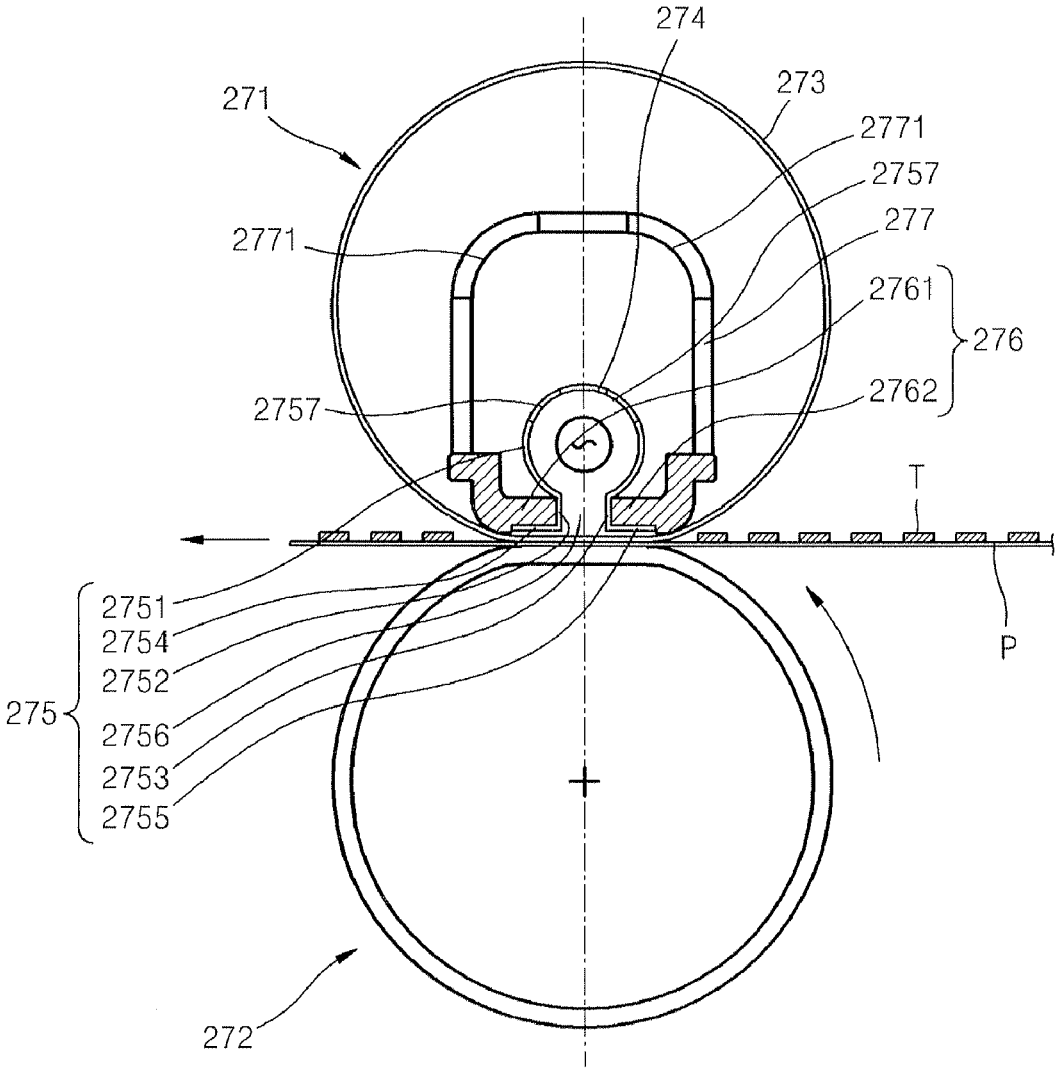
FIG. 18 is a longitudinal cross-sectional view illustrating a fusing apparatus according to another embodiment of the present general inventive concept.
Figure 19:
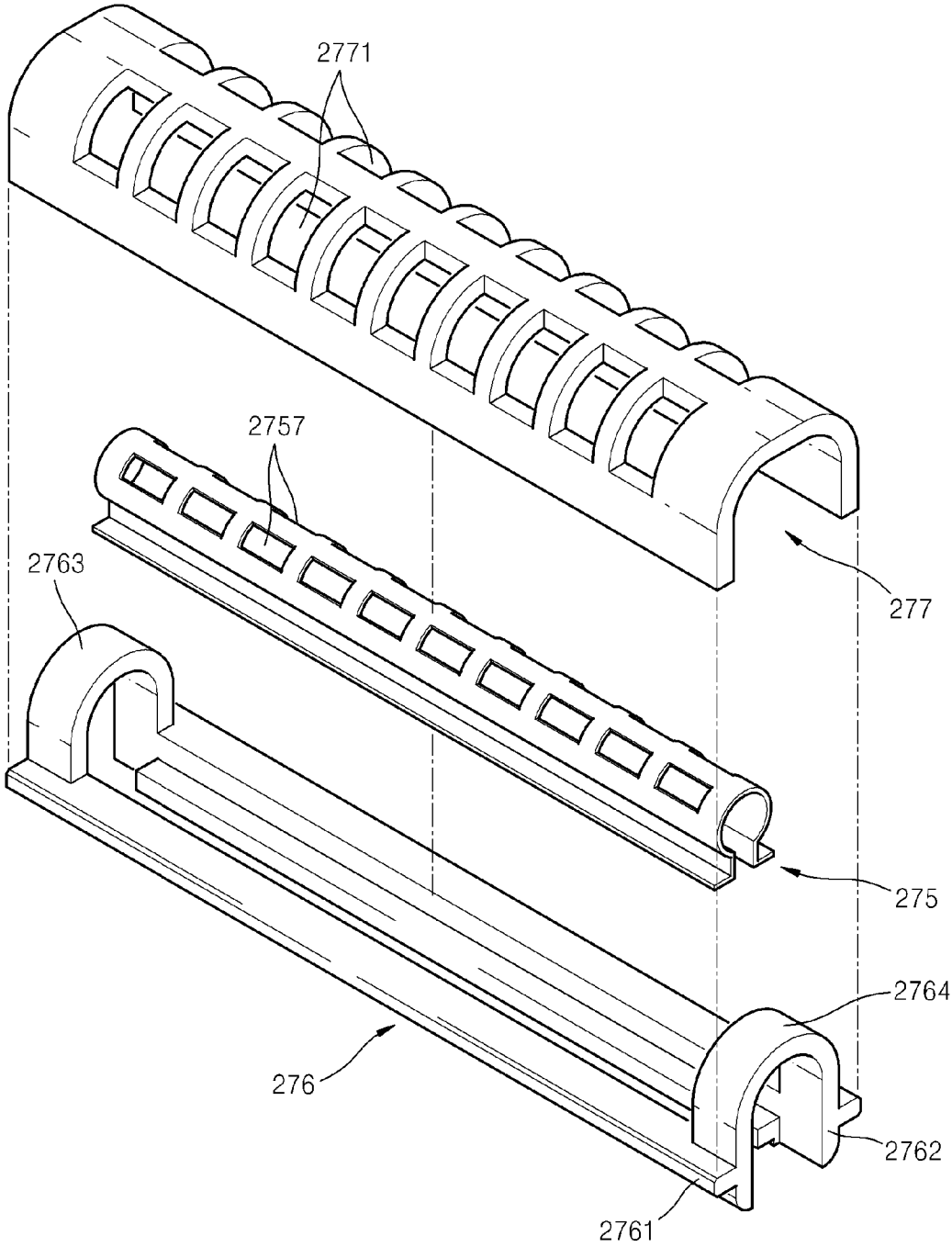
FIG. 19 is an exploded perspective view separately illustrating the nip forming member, the supporting member, and the pressurizing member illustrated in FIG. 18.

FIG. 2 is a lateral cross-sectional view illustrating an electrophotographic image forming apparatus 100 including a fusing apparatus according to an embodiment of the present general inventive concept; FIG. 3 is a longitudinal cross-sectional view illustrating the fusing apparatus illustrated in FIG. 2; FIG. 4 is a perspective view separately illustrating a nip forming member, a supporting member, and a pressurizing member illustrated in FIG. 3; FIGS. 5A and 5B illustrate a supporting member according to an embodiment of the present general inventive concept; FIG. 6 illustrates a supporting member according to another embodiment of the present general inventive concept; FIGS. 7A and 7B illustrate a supporting member according to another embodiment of the present general inventive concept; FIGS. 8A and 8B illustrate a supporting member according to another embodiment of the present general inventive concept; FIGS. 9A and 9B illustrate a supporting member according to another embodiment of the present general inventive concept; FIG. 10 illustrates a supporting member according to another embodiment of the present general inventive concept; FIGS. 11A and 11B illustrate a supporting member according to another embodiment of the present general inventive concept; FIGS. 12A and 12B illustrate a supporting member according to another embodiment of the present general inventive concept; FIGS. 13A and 13B illustrate a supporting member according to another embodiment of the present general inventive concept; FIG. 14 illustrates a supporting member according to another embodiment of the present general inventive concept; FIG. 15 illustrates a nip forming member according to another embodiment of the present general inventive concept; FIG. 16A is a graph illustrating a temperature change in a nip of the fusing apparatus according to an embodiment of the present general inventive concept; FIG. 16B is a graph illustrating a pressure change in a nip of the fusing apparatus according to an embodiment of the present general inventive concept; FIG. 17 is a graph illustrating a temperature increase rate of the supporting member according to an embodiment of the present general inventive concept; FIG. 18 is a longitudinal cross-sectional view illustrating a fusing apparatus according to another embodiment of the present general inventive concept; and FIG. 19 is an exploded perspective view separately illustrating the nip forming member, the supporting member, and the pressurizing member illustrated in FIG. 18.

Referring to FIG. 2, the electrophotographic image forming apparatus 100 prints an image on a printing medium according to an electrophotographic process, and includes a cassette 110 to accommodate a plurality of printing medium P, wherein the cassette 110 is disposed to be attachable to and detachable from a main body 101, a developing cartridge 120, an exposing unit 130, transferring rollers 140, a roller 160, a transferring belt 151, a fusing apparatus 170, and a discharging unit 180.

The cassette 110 is elastically biased by an elastic unit 112 and includes a printing medium supporting plate 111 on which the printing medium P is loaded. A pickup roller 113 is disposed above the cassette 110 to pick up the printing medium P sheet by sheet.

The developing cartridge 120 stores and supplies toner to an electrostatic latent image corresponding to a print digital signal to develop the electrostatic latent image into a toner image. The developing cartridge 120 includes a plurality of developing cartridges 120C, 120M, 120Y, and 120K including photosensitive drums 121C, 121M, 121Y, and 121K corresponding to the colors of the toners, cyan (C), magenta (M), yellow (Y), and black (K), respectively.

The exposing unit 130 forms an electrostatic latent image according to a digital printing signal by radiating light onto the photosensitive drums 121C, 121M, 121Y, and 121K, and includes a plurality of exposing units 130C, 130M, 130Y, and 130K, respectively corresponding to the developing cartridges 120C, 120M, 120Y, and 120K.

The transferring belt 151 is supported by a plurality of rollers 152, 153, 154, and 155 and disposed to rotate along a closed curve to contact the photosensitive drums 121C, 121M, 121Y, and 121K. Thus, the transferring belt 151 transports the printing medium P, which is picked up from the cassette 110 and transported by the transferring roller 114, by sequentially contacting the printing medium P with the developing cartridges 120C, 120M, 120Y, and 120K. As the printing medium P is sequentially contacted to the photosensitive drums 121C, 121M, 121Y, and 121K, a plurality of toner images formed on the photosensitive drums 121C, 121M, 121Y, and 121K are sequentially transferred to the printing medium P, and thus a desired image is formed.

A charge roller 156, to charge the transferring belt 151 with a predetermined electric potential by contacting the transferring belt 151, is disposed below the transferring belt 151. The charge roller 156 charges the transferring belt 151 with predetermined electric charges such that the printing medium P can be attached to the transferring belt 151.

The transferring rollers 140 are disposed to face the photosensitive drums 121C, 121M, 121Y, and 121K within the loop of the transferring belt 151, respectively, and transfer a toner image T formed on the photosensitive drums 121C, 121M, 121Y, and 121K to the printing medium P transporting by the transferring belt 151.

The discharge unit 180 discharges the printing medium, on which the toner image T is fused by passing through the fusing apparatus 170 and includes a pair of rollers facing each other to discharge the printing medium. The printing medium P is discharged by the discharge unit 180 and loaded on a discharge plate 190.

The fusing apparatus 170 fuses a toner image T on a printing medium P by applying heat and pressure, and is disposed in a width direction of the printing medium P. The fusing apparatus 170 includes a heating unit 171 to apply heat to a toner image, and a pressurizing roller 172 facing and contacting the heating unit 171 and to apply an elastic force to the printing medium P passing between the heating unit 171 and the pressurizing roller 172. The pressurizing roller 172 includes a core pipe, which is formed of a metal such as iron, steel, stainless steel, aluminum, copper or metal alloy, ceramics, FRM, and the like; an elastic layer stacked on an outer surface of the core pipe; and a release layer as an outermost layer. The elastic layer may be formed of silicon rubber, fluorine rubber, etc. The silicon rubber may be RTV silicon rubber, HTV silicon rubber, and the like, and specifically, polydimethyl rubber, metal vinyl silicon rubber, metal phenyl silicon rubber, fluor silicon rubber, etc. The release layer may be formed of fluorine rubber, silicon rubber, fluorine resin, etc., and may be formed of fluorine rubber.

Referring to FIGS. 3 and 4, the heating unit 171 includes a fusing film 173, a heat source 174, a nip forming member 175, a supporting member 176, and a pressing member 177.

The fusing film 173 has a tubular and endless shape, has a small thickness, and faces and contacts the pressurizing roller 172. Although not illustrated in the drawing, the fusing film 173 may include a base layer and an elastic layer and/or release layer formed on the base layer. The base layer may be formed of a polymer material such as PI, PEEK, etc. or Ni, Ni alloy, stainless steel, Al, Al alloy, Cu, Cu alloy, etc. The fusing film 173 has a small thermal capacity, and thus, the temperature of the fusing film 173 can be increased rapidly by heat.

The nip forming member 175 is formed within the fusing film 173, and has a portion of the fusing film 173 contacting the pressurizing roller 172, thereby forming a nip to fuse a toner image T on a printing medium P.

The nip forming member 175 includes a main body 1751 surrounding the heat source 174, a plurality of adhering portions 1754 and 1755 having an opening portion 1756 on a horizontal base therebetween and adhering a portion of the fusing film 173 toward the pressurizing roller 172, and a plurality of opening forming portions 1752 and 1753 that are formed vertically with respect to the adhering portions 1754 and 1755 so as to connect each of the adhering portions 1754 and 1755 to the main body 1751 and form the opening portion 1756. Accordingly, a nip N has a length as long as, for example, the adhering portions 1754 and 1755, and the opening portion 1756 contacts the fusing film 173. The heat generated by the heat source 174 can be transferred directly to the fusing film 173 via the opening portion 1756. The nip forming member 175 may be a thin film metal plate, and the material thereof may be a metal such as iron, stainless steel, Al, copper (Cu), and alloy thereof. Moreover, the nip forming member 175 may be formed of ceramics, FRM, etc. The cross-section of the nip forming member 175 is omega-shaped, and the heat source 174 is placed within the nip forming member 175. However, a shape of the cross-section of the nip forming member 175 is not limited to the omega shape, and except for the adhering portions 1754 and 1755, the main body 1751 and the opening forming portions 1752 and 1753 may have various shapes.

The supporting member 176 supports the nip forming member 175 and prevents thermal deformation of the nip forming member 175, and includes a first supporting portion 1761 and a second supporting portion 1762. The first supporting portion 1761 contacts and thus supports the opening forming portion 1752 and the adhering portion 1754, and the second supporting portion 1762 contacts and thus supports the opening forming portion 1753 and the adhering portion 1755. The first supporting portion 1761 and the second supporting portion 1762 are connected by a plurality of bridges 1763 and 1764. The bridges 1763 and 1764 may be formed on both ends of the first supporting portion 1761 and the second supporting portion 1762.

The supporting member 176 may be formed of a metal material such as a metal such as iron, stainless steel, Al, copper (Cu), metal alloy, ceramics, or FRM, or may be formed of a polymer material having thermal resistance.

The pressing member 177 is disposed above the supporting member 176 so as to press the supporting member toward the pressurizing roller 172. Accordingly, the pressing member 177 surrounds the nip forming member 175. The pressing member 177 is elastically biased toward the pressurizing roller 172 by an elastic unit (not illustrated in the drawing), and thus the pressurizing roller 177 pushes the supporting member 176 toward the pressurizing roller 172.

The nip forming member 175, the supporting member 176, and the pressurizing member 177 that constitute the heating unit 171 are fixed, and the fusing film 173 is rotatably contacted to the pressurizing roller 172.

The heat source 174 may be formed on the normal L (denoted by an alternated long and short dash line), running through a center of the pressurizing roller 172 and a middle of the opening portion 1756 so that the heat generated from the heat source 174 can be transferred as much as possible to the nip N via the opening portion 1756.

Since the heat generated from the heat source 174 is dissipated radially, the heat is transferred not only to the main body 1751 of the nip forming member 175 and then to the adhering portions 1754 and 1755, but also some of the heat is also directly transferred to the fusing film 173 passing the nip N via the opening portion 1756, thereby increasing the temperature of the nip N.

presence of an opening portion does not pose an intolerable problem in respect to the pressing force. A tension of the fusing film 173 by the pressing force in the first adhering portion 1754 and the second adhering portion 1755 and the elastic force in the pressurizing roller 172 act together to reduce the reduction of the pressing force in the opening portion 1756.

Meanwhile, a relationship between a ratio of the opening portion 1756 occupying the width of the nip N and the pressing force needs to be examined. Since the fusing property differs according to the ratio of the opening portion 1756 occupying the width of the nip N, the relationship therebetween needs to be examined in order to maximize the fusing property based on property differences.

When the nip N is 9 mm long and the width of the opening portion 1756 is too small, a temperature decline prevention effect in the nip N becomes small. Alternatively, if the width of the opening portion 1756 is too large, the temperature increase rate in the nip N increases but a width of the first adhering portion 1754 or the second adhering portion 1755 decreases, and an adhering property between the fusing film 173 and the pressurizing roller 172 in a center is decreased, thereby reducing the fusing property.

The first print fusing property according to the pressing force and an opening rate of the nip N is illustrated in Table 1 below, wherein ○ denotes a good fusing property, Δ denotes a normal fusing property and X denotes a poor fusing property.

TABLE 1

| | Opening rate | | | | | | | | | |
|---|---|---|---|---|---|---|---|---|---|---|
| | 0% | 5% | 10% | 20% | 30% | 40% | 50% | 60% | 70% | 80% |
| Pressurizing force 6 kgf | X | X | Δ | ○ | ○ | ○ | Δ | Δ | X | X |
| Pressuring force 10 kgf | X | Δ | ○ | ○ | ○ | ○ | ○ | Δ | Δ | X |
| Pressurizing force 14 kgf | Δ | Δ | ○ | ○ | ○ | ○ | ○ | ○ | ○ | X |

In FIGS. 16A and 16B, a thick solid line denotes temperature and pressure profiles of the nip N when the opening portion 1756 according is formed, and a thin solid line denotes temperature and pressure profiles of the nip N when the opening portion 1756 is not formed.

As illustrated in FIG. 16A, when there is no opening portion 1755, the temperature is declining from the starting point Ns to the end point Ne of the nip N; however, when there is an opening portion 1755, the decline of the temperature is delayed or the temperature increases in a range from the starting point Ns to the end point Ne of the nip N. This is because, when the opening portion 1755 is formed, some of the heat generated from the heat source 174 is directly transferred to the nip N, and thus the temperature of the nip N does not decline continuously or is rather increased.

As illustrated in FIG. 16B, when the opening portion 1756 exists between the first adhering portion 1754 and the second adhering portion 1755, a pressing force in the opening portion 1756 is reduced compared to the case when the opening portion does not exist. However, the pressing force in the first adhering portion 1754 and the second adhering portion 1755 is increased compared to the case without the opening portion. Accordingly, a reduction of the pressing force in the opening portion 1756 is compensated for. Accordingly, the The total width of the nip N was 9 mm, and a fusing film formed of SUS having a thickness of 40 μm was used. A halogen lamp was used as a heat source.

When the pressurizing force was 14 kgf, the first print fusing property was secured when the opening rate was 70%, however, the elastic layer of the pressurizing roller was permanently deformed. Considering the lifetime of the pressurizing roller, the nip opening rate may be 10-50%, for example, 20-40%.

Meanwhile, referring to FIG. 15, when an angle between the opening forming portion 1752 and the adhering portion 1754 is θ1, an angle between the opening forming portion 1753 and the adhering portion 1755 is θ2, and an angle between the adhering forming portions 1754 and 1755 is θ, the angles θ1 and θ2 are obtuse angles, and thus θ is less than 180°. Since θ is less than 180°, the adhering portions 1754 and 1755 adhere the fusing film 173 to the pressurizing roller 172 in an arc shape, and thus the shape of the nip N is an arc, thereby enlarging the nip N by 3-8%. Accordingly, when the angle between the adhering portions 1754 and 1755 is less than 180°, the nip N is enlarged, and under a small pressing force of 6 kgf or less, the fusing property of the nip N is increased by 10% or more. Also, the pressing force along the pressing surface becomes uniform, thereby solving quality problems such as deformation of the printing medium.

If the angle θ between the adhering forming portions 1754 and 1755 is set to be greater than 180°, paper jam was generated intermittently when a line end image density was great on a thin printing medium, and deformation marks were created on the pressurizing roller. However, when the angle θ between the adhering forming portions 1754 and 1755 is less than 180°, the above described problems did not appear. If the angle θ between the opening forming portions 1754 and 1755 is set to be greater than 180°, paper jam was generated intermittently when a line end image density was great on a thin printing medium, and deformation marks were created on the pressurizing roller. However, when the angle θ between the opening forming portions 1754 and 1755 is less than 180°, the above described problems did not appear.

Meanwhile, a portion of the heat transferred to the nip forming member 175 is transferred to the supporting member 176 contacting the nip forming member 175, and thus the temperature increasing function of the nip N may be decreased due to the increase of the thermal capacity. Accordingly, the heat transfer from the nip forming member 175 to the supporting member 176 needs to be minimized.

In order to realize this, methods illustrated in FIGS. 5A through 13 may be applied. These methods relate to reducing the contact surface between the supporting member 176 and the nip forming member 175.

Referring to FIGS. 5A and 5B, FIG. 5A is a cross-sectional view illustrating a supporting member, and FIG. 5B is a plane view illustrating the supporting member. Step portions 211 and 212 are respectively formed at end portions of a first supporting portion 1761 and a second supporting portion 1762. Accordingly, the step portions 211 and 212 each contact the opening forming portions 1752 and 1753 but do not contact the adhering portions 1754 and 1755. Accordingly, a total contact surface between the supporting member 176 and the nip forming member 175 is reduced compared to that illustrated in FIG. 3.

Referring to FIG. 6, round-shaped step portions 213 and 214 are respectively formed at end portions of the first supporting portion 1761 and the second supporting portion 1762. Accordingly, as the end portions of the step portions 213 and 214 are round-shaped, the total contact surface between the first supporting portion 1761 and the second supporting portion 1762 and the opening forming portions 1752 and 1753 can be reduced more as compared to a case illustrated in FIGS. 5A and 5B.

FIG. 7A is a cross-sectional view illustrating a supporting member, and FIG. 7B is a plane view illustrating a supporting member. A plurality of step portions 215 having predetermined intervals therebetween are formed at end portions of the first supporting portion 1761 in a length direction (a width direction of the printing medium), and a plurality of step portions 216 having predetermined intervals therebetween are formed at end portions of the second supporting portion 1762 in the length direction (the width direction of the printing medium). Accordingly, the total contact surface between the supporting member 176 and the nip forming member 175 is reduced compared to that illustrated in FIG. 3.

FIG. 8A is a cross-sectional view illustrating a supporting member, and FIG. 8B is a plane view illustrating the supporting member. A plurality of step portions 217 having a round-shaped end portion having predetermined intervals therebetween are formed at end portions of the first supporting portion 1761 in the length direction (the width direction of the printing medium), and a plurality of step portions 218 having a round-shaped end portion having predetermined intervals therebetween are formed, at end portions of the second supporting portion 1762 in the length direction (the width direction of the printing medium). Accordingly, the total contact surface between the supporting member 176 and the nip forming member 175 is reduced compared to that illustrated in FIG. 7.

FIG. 9A is a cross-sectional view illustrating a supporting member, and FIG. 9B is a bottom view illustrating the supporting member. Step portions 221 and 222 are formed at end portions of the first supporting member 1761 and the second supporting portion 1762 to respectively contact the adhering portions 1754 and 1755. The step portions 221 and 222 do not contact the opening forming portions 1752 and 1753 and contact only a portion of the adhering portions 1754 and 1755. Accordingly, the total contact surface between the supporting member 176 and the nip forming member 175 is reduced compared to that illustrated in FIG. 3.

Referring to FIG. 10, round-shaped step portions 223 and 224 are formed at end portions of the first supporting portion 1761 and the second supporting portion 1762 to contact each of the adhering portions 1754 and 1755. Accordingly, as the end portions of the step portions 223 and 224 are round-shaped, the contact surface between the supporting member 176 and the nip forming member 175 can be reduced compared to that illustrated in FIGS. 5A and 5B.

FIG. 11A is a cross-sectional view illustrating a supporting member, and FIG. 11B is a bottom view illustrating the supporting member. A plurality of step portions 225 are formed at predetermined intervals at an end of a first supporting portion 1761 in the length direction (the width direction of the printing medium), and plurality of step portions 226 are formed at predetermined intervals at an end of a first supporting portion 1762 in the length direction (the width direction of the printing medium). Accordingly, the total contact surface area between the supporting member 176 and the nip forming member 175 is reduced compared to that illustrated in FIGS. 9A and 9B.

FIG. 12A is a cross-sectional view illustrating a supporting member, and FIG. 12B is a bottom view illustrating the supporting member. A plurality of step portions 227 having a round-shaped end portion are formed at predetermined intervals at an end of a first supporting portion 1761 in the length direction (the width direction of the printing medium), and plurality of step portions 228 having a round-shaped end portion are formed at predetermined intervals at an end of a first supporting portion 1762 in the length direction (the width direction of the printing medium). Accordingly, the total contact surface area between the supporting member 176 and the nip forming member 175 is reduced compared to that illustrated in FIG. 10.

Figure 13C:
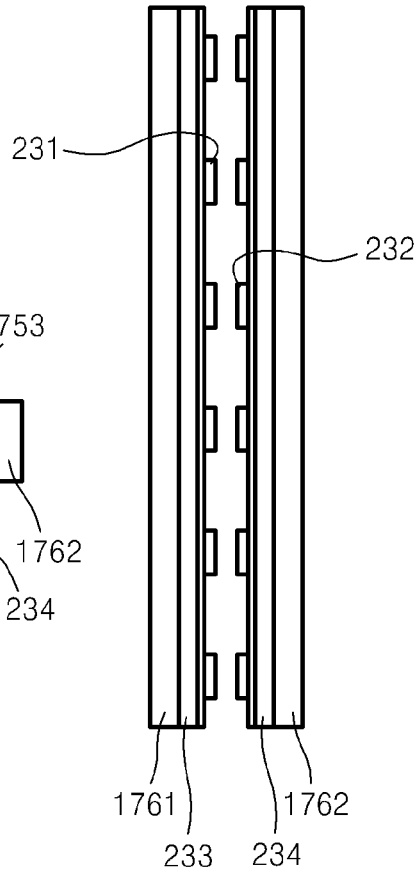

FIG. 13A is a cross-sectional view illustrating a supporting member, and FIG. 13B is a bottom view of the supporting member, and FIG. 13C is a plane view illustrating the supporting member. Step portions 231 are formed at an end of the first supporting member 1761 to contact the opening forming portion 1752, and step portions 233 are formed to contact the adhering portions 1754. A plurality of step portions 231 and 233 are formed at predetermined intervals in the length direction of the first supporting member 1761 (the width direction of the printing medium).

Also, step portions 232 are formed at an end of the second supporting member 1762 to contact the opening forming portion 1752, and step portions 234 are formed to contact the adhering portions 1754. A plurality of the step portions 232 and 234 are formed at predetermined intervals in the length direction (the width direction of the printing medium).

Accordingly, the total contact surface area between the supporting member 176 and the nip forming member 175 is reduced compared to that illustrated in FIGS. 3 through 12B.

Referring to FIG. 17, a thick solid line denotes an increase rate of a temperature of the conventional fusing apparatus illustrated in FIG. 1; a thick dotted line denotes an increase rate of a temperature of the fusing apparatus illustrated in FIG. 3 of the present general inventive concept; an alternated long and short dash line denotes an increase rate of a temperature of the fusing apparatus illustrated in FIG. 5 of the present general inventive concept; and a thin dotted line denotes an increase rate of a temperature of the fusing apparatus illustrated in FIG. 13 of the present general inventive concept.

Referring to FIGS. 13 and 17, the increase rate of the temperature of the fusing apparatus denoted by the thick solid line is 4.5° C./s; the increase rate of the temperature denoted by the thick dotted line is 9.3° C./s; the increase rate of the temperature denoted by the alternated long and short dash line is 11.7° C./s; and the increase rate of the temperature denoted by the thin dotted line is 13.5° C./s.

Accordingly, the fusing apparatus has an increased temperature increase rate compared to the conventional fusing apparatus. Also, step portions 1754 and 1755 are formed on all portions where the first supporting portions 1761 and the second supporting portions 1762 contact the adhering portions 1754 and 1755 and the opening forming portions 1752 and 1753 to reduce the contact surface area therebetween. Accordingly, heat transfer is reduced and thus the increase rate of the temperature of the fusing apparatus can be further increased.

Meanwhile, as illustrated in FIG. 14, insulating portions 178 are formed between the nip forming member 175 and the supporting member 176 to prevent heat from transferring from the nip forming member 175 to the supporting member 176. The shape and material of the insulating portions 178 is not limited to the descriptions in the present general inventive concept.

Referring to FIGS. 18 and 19, the fusing apparatus fuses a toner image T onto a printing medium P by applying heat and pressure, is disposed in the width direction of the printing medium P, and includes a heating unit 271 and a pressurizing roller 272 that faces the heating unit 271 and applies an elastic force to the printing medium P passing through a contact surface (a nip) toward the heating unit 271.

The heating unit 271 includes a fusing film 273, a heat source 274, a nip forming member 275, a supporting member 276, and a pressing member 277.

The fusing film 273 has a tubular and endless shape, has a small thickness, and is disposed to face and contact the pressurizing roller 172.

The nip forming member 275 is formed inside the fusing film 273, and forms a nip to fuse a toner image T onto a printing medium P by contacting a portion of the fusing film 273 with the pressurizing roller 272. The nip forming member 275 is omega-shaped, and the heat source 274 is place inside the nip forming member 275.

The nip forming member 275 includes a round-shaped main body 2751, a plurality of adhering portions 2754 and 2755 having an opening portion 2756 on a horizontal basis therebetween and adhering a portion of the fusing film 273 toward the pressurizing roller 272, and a plurality of opening forming portions 2752 and 2753 formed vertically to the adhering portions 2754 and 2755 to connect the adhering portions 2754 and 2755 to the body 2751 to form the opening portion 2756. Accordingly, the nip N has a length, for example, as long as the adhering portions 2754, and 2755 and the opening portion 2756 contacts the fusing film 273.

The supporting member 276 supports the nip forming member 275 and thus prevents thermal deformation of the nip forming member 275, and includes a first supporting portion 2761 and a second supporting portion 2762. The first supporting portion 2761 contacts and thus supports the opening forming portion 2752 and the adhering portion 2754, and the second supporting portion 2762 contacts and thus supports the opening forming portion 2753 and the adhering portion 2755. The first supporting portion 2761 and the second supporting portion 2762 are connected by a plurality of bridges 2763 and 2764.

The pressing member 277 is formed above the supporting member 276 to push the supporting member 276 toward the pressurizing roller 272. Accordingly, the pressing member 277 surrounds the nip forming member 275 which is formed inside the pressing member 277.

A plurality of through holes 2757 are formed in the body 2751 of the nip forming member 275, and a plurality of through holes 2771 are formed in the pressurizing member 277. The through holes 2757 of the nip forming member 275 and through holes 2771 of the pressing member 277 are formed to correspond to each other. Accordingly, heat generated from the heat source 274 passes through the through holes 2757 of the nip forming member 275 and the through holes 2771 of the pressing member 277 to be transferred to the fusing film 273. Accordingly, since the portion of the fusing film 273 is heated before passing the nip N by the heat transferred through the through holes 2757 and 2771, the increase rate of the temperature can be increased.

As described above, the fusing apparatus according to the present general inventive concept has, for example, the following utilities.

An increase rate of the temperature of a fusing apparatus can be increased by using a fusing film having a small thermal capacity and passing through a nip to which heat is directly transferred.

As heat transfer from a nip forming member to a supporting member is minimized, thermal efficiency in the nip is increased.

A plurality of through holes are formed in a nip forming member and a pressing member so that heat generated from a heat source can be transferred to a fusing film through the through holes, thereby increasing the thermal efficiency.

While the present general inventive concept has been particularly illustrated and described with reference to exemplary embodiments thereof, it will be understood by those of ordinary skill in the art that various changes in form and details may be made therein without departing from the spirit and scope of the present general inventive concept as defined by the following claims.

What is claimed is:

1. A fusing apparatus, comprising:

a heating unit to generate heat to fuse an image onto a printing medium;

a pressurizing roller that faces and contacts the heating unit having an endless fusing film that is rotated while facing and contacting the pressurizing roller and presses the printing medium toward the heating unit;

a nip forming member to contact a portion of the fusing film to the pressing roller to form a nip comprising:

a main body formed inside the fusing film to surround a heat source;

a plurality of adhering portions having an opening portion on a horizontal base therebetween and adhering a portion of the fusing film toward the pressurizing roller;

a plurality of opening forming portions formed vertically with respect to the adhering portions so as to connect each of the adhering portions to the main body and form the opening portion such that heat generated from the heating unit arrives at the fusing film via the opening portion; and a supporting member to support the nip forming member.

2. The fusing apparatus of claim 1, further comprising:

a pressing member to press the supporting member toward the pressurizing roller, wherein the pressing member is disposed to surround the nip forming member.

3. The fusing apparatus of claim 1, wherein the nip forming member is formed of a thin film metal plate.

4. The fusing apparatus of claim 3, wherein a cross-section of the nip forming member is omega-shaped.

5. The fusing apparatus of claim 1, wherein the heat source is positioned on a normal axis penetrating a center of the opening portion.

6. The fusing apparatus of claim 1, wherein the supporting member further comprises:

step portions formed on an area contacting the opening forming portion.

7. The fusing apparatus of claim 6, wherein a plurality of the step portions having predetermined intervals therebetween are formed in a width direction of a printing medium.

8. The fusing apparatus of claim 1, wherein the supporting member further comprises:

step portions formed on an area contacting the adhering portions.

9. The fusing apparatus of claim 8, wherein a plurality of the step portions having predetermined intervals therebetween are formed in a width direction of a printing medium.

10. The fusing apparatus of claim 1, wherein the supporting member further comprises:

step portions respectively formed on an area contacting the opening forming portions and the adhering portions.

11. The fusing apparatus of claim 10, wherein a plurality of the step portions having predetermined intervals therebetween are formed in a width direction of a printing medium.

12. The fusing apparatus of claim 11, wherein the main body and the pressing member of the nip forming member include a plurality of through holes formed such that heat generated from the heat source can be radiated to the fusing film.

13. The fusing apparatus of claim 1, wherein the supporting member further comprises:

adiabatic portions formed on an area contacting the opening forming portions and the adhering portions.

14. The fusing apparatus of claim 1, wherein the adhering portions form an angle of 180' or less and press the fusing film to the pressurizing roller.

15. An electrophotographic image forming apparatus, comprising:

a plurality of developing cartridges in which toner of various colors is stored to develop an electrostatic latent image into a toner image;

a transferring belt to transport a printing medium while contacting the printing medium to the developing cartridges;

a fusing apparatus to fuse the toner image on the printing medium, the fusing apparatus comprises:

a heating unit to generate heat to fuse an image onto a printing medium; and a pressurizing roller that faces and contacts the heating unit having an endless fusing film that is rotated while facing and contacting the pressurizing roller and presses the printing medium toward the heating unit;

a nip forming member to contact a portion of the fusing film to the pressing roller to form a nip comprising:

a main body formed inside the fusing film to surround a heat source;

a plurality of adhering portions having an opening portion on a horizontal base therebetween and adhering a portion of the fusing film toward the pressurizing roller;

a plurality of opening forming portions formed vertically with respect to the adhering portions so as to connect each of the adhering portions to the main body and form the opening portion such that heat generated from the heating unit arrives at the fusing film via the opening portion; and a supporting member to support the nip forming member.

16. The electrophotographic image forming apparatus of claim 15, further comprising:

a pressing member to press the supporting member toward the pressurizing roller, wherein the pressing member is disposed to surround the nip forming member.

17. The electrophotographic image forming apparatus of claim 15, wherein the nip forming member is formed of a thin film metal plate.

18. A fusing apparatus usable with an image forming apparatus, the fusing apparatus comprising:

a pressurizing roller;

a fusing film to contact the pressurizing roller; and a nip forming member including a plurality of adhering portions disposed on each side of an opening portion, wherein a tension in the fusing film created by a pressing force of the plurality of adhering portions and an elastic force in the pressurizing roller act together to limit a reduction of a pressure force in the opening portion.

* * * * *